US007993080B2

(12) United States Patent
Erez et al.

(10) Patent No.: US 7,993,080 B2
(45) Date of Patent: Aug. 9, 2011

(54) EARTHQUAKE RESISTANT EARTH RETENTION SYSTEM USING GEOCELLS

(75) Inventors: Oded Erez, Tel Aviv (IL); Adi Erez, Tel Aviv (IL)

(73) Assignee: PRS Mediterranean Ltd., Tel Aviv (IL)

( * ) Notice: Subject to any disclaimer, the term of this patent is extended or adjusted under 35 U.S.C. 154(b) by 0 days.

(21) Appl. No.: 12/238,961

(22) Filed: Sep. 26, 2008

(65) Prior Publication Data

US 2009/0142144 A1 Jun. 4, 2009

Related U.S. Application Data

(60) Provisional application No. 60/975,578, filed on Sep. 27, 2007.

(51) Int. Cl.
*E02D 17/18* (2006.01)

(52) U.S. Cl. ..... 405/284; 405/302.4

(58) Field of Classification Search ..... 405/284, 405/302.4–302.7

See application file for complete search history.

(56) References Cited

U.S. PATENT DOCUMENTS

| | | | | | |
|---|---|---|---|---|---|
| 1,165,194 | A | * | 12/1915 | Maccaferri | 405/16 |
| 3,922,864 | A | | 12/1975 | Hilfiker | |
| 4,117,686 | A | | 10/1978 | Hilfiker | |
| 4,394,924 | A | * | 7/1983 | Zaccheroni | 220/486 |
| 4,426,176 | A | | 1/1984 | Terada | |
| 4,448,571 | A | * | 5/1984 | Eckels | 405/284 |
| 4,557,634 | A | | 12/1985 | Vidal | |
| 4,661,014 | A | | 4/1987 | Aubert | |
| 4,778,309 | A | | 10/1988 | Bach et al. | |
| 4,815,897 | A | * | 3/1989 | Risi et al. | 405/284 |
| 4,856,939 | A | | 8/1989 | Hilfiker | |
| 4,960,349 | A | * | 10/1990 | Willibey et al. | 405/262 |
| 4,965,097 | A | | 10/1990 | Bach | |
| 5,076,735 | A | * | 12/1991 | Hilfiker | 405/284 |
| 5,161,917 | A | * | 11/1992 | Papetti | 405/284 |
| 5,190,413 | A | * | 3/1993 | Carey | 405/286 |
| 5,320,455 | A | | 6/1994 | Mattox | |
| 5,522,682 | A | | 6/1996 | Egan | |
| 5,540,525 | A | | 7/1996 | Miller et al. | |
| 5,549,418 | A | * | 8/1996 | Devine et al. | 405/258.1 |

(Continued)

FOREIGN PATENT DOCUMENTS

EP 0 378 309 A1 7/1990

(Continued)

OTHER PUBLICATIONS

"Gabion Walls Design" at http://www.gabions.net/downloads/Documents/MGS_Design_Guide.pdf.*

(Continued)

*Primary Examiner* — Tara Mayo-Pinnock
(74) *Attorney, Agent, or Firm* — Richard M. Klein; Fay Sharpe LLP

(57) ABSTRACT

A retaining wall comprises a plurality of layers made from geocells. The retaining wall has a capping layer at the top of the wall, wherein the ratio of the length of the capping layer to the height of the retaining wall is at least 0.8. The retaining wall also has at least one stacking layer and may further comprise a reinforcing layer made of geogrids or, preferably, geocells. The reinforcing geocells have a height that is less than the height of the capping layer geocell.

9 Claims, 10 Drawing Sheets

U.S. PATENT DOCUMENTS

| | | | | |
|---|---|---|---|---|
| 5,582,492 | A | 12/1996 | Doyle, Jr. | |
| 5,636,938 | A * | 6/1997 | Ragazzo | 405/15 |
| 6,036,405 | A | 3/2000 | Nove et al. | |
| 6,168,349 | B1 * | 1/2001 | Perslow et al. | 405/16 |
| 6,238,144 | B1 * | 5/2001 | Babcock | 405/284 |
| 6,315,499 | B1 | 11/2001 | Kittson | |
| 6,395,372 | B1 | 5/2002 | Bach | |
| 6,554,545 | B1 * | 4/2003 | Hall | 405/302.4 |
| 6,558,085 | B1 | 5/2003 | Hall | |
| 6,565,289 | B2 | 5/2003 | Khamis | |
| 6,719,498 | B2 * | 4/2004 | Barley | 405/259.5 |
| 6,808,339 | B2 | 10/2004 | Peterson et al. | |
| 6,890,127 | B1 * | 5/2005 | Barrett et al. | 405/73 |
| 6,893,193 | B2 * | 5/2005 | Santha | 405/302.6 |
| 7,033,118 | B2 * | 4/2006 | Hilfiker | 405/262 |
| 7,048,473 | B2 | 5/2006 | Takemiya | |
| 7,125,202 | B2 | 10/2006 | Morizot et al. | |
| 7,270,502 | B2 | 9/2007 | Brown | |
| 7,425,107 | B2 * | 9/2008 | Derache | 405/262 |
| 2006/0147276 | A1 | 7/2006 | Lin et al. | |

FOREIGN PATENT DOCUMENTS

| | | | |
|---|---|---|---|
| EP | 1 054 110 | B1 | 1/2006 |
| GB | 2 167 794 | A | 6/1986 |
| JP | 06-92218 | A2 | 5/1986 |
| WO | WO 00/14339 | A1 | 3/2000 |
| WO | WO 2007/074448 | A2 | 7/2007 |

OTHER PUBLICATIONS

Presto Products Company, The Geoweb(R) Earth Retention System Technical Overview, Aug. 11, 2003, 12 pages, Presto Products Company, Appleton, Wisconsin.

* cited by examiner

EARTHQUAKE RESISTANT EARTH RETENTION SYSTEM USING GEOCELLS

RELATED APPLICATIONS

The present application claims priority to U.S. Provisional Patent Application Ser. No. 60/975,578, filed Sep. 27, 2007, the contents of which are fully incorporated herein by reference.

BACKGROUND

The present disclosure relates to earth retention systems including retaining walls built from cellular confinement systems, also known as geocells. In particular, such retaining walls are especially resistant to dynamic loads, such as shock waves related to seismic activity from earthquakes. The present disclosure also relates to the components of such walls and methods for making and using such retaining walls.

A cellular confinement system (CCS) is an array of containment cells resembling a "honeycomb" structure that is usually filled with cohesionless soil, sand, gravel, or any other type of aggregate. Also known as geocells, CCSs are used in applications to prevent erosion or provide lateral support, such as gravity retaining walls for soil, alternatives for sandbag walls, and for roadway and railway foundations. The infill and the geocell are coupled via friction and interlocking mechanisms. CCSs differ from geogrids or geotextiles in that geogrids/geotextiles are generally flat (i.e., two-dimensional) and used as planar reinforcement, whereas CCSs are three-dimensional structures with internal force vectors acting within each cell against all the walls. In addition, stress transfer in geogrids/geotextiles is much more sensitive to the infill type and installation quality. Geocells, on the other hand, can tolerate more damage due to its three-dimensional structure.

CCSs are commercially available, such as the Geoweb® earth retention system, from Presto Products Company, a popular CCS. Presto utilizes polyethylene (PE) as the material of choice when fabricating geocells. Polyethylene is low cost and has very good chemical resistance. However, relative to other polymeric materials used in soil reinforcement (e.g., polyester, polyvinyl alcohol), polyethylene has low stiffness, low strength, high creep, and high coefficient of thermal expansion. In particular, PE's long term stiffness is about 20%-25% that of its original stiffness. This decreases further when it is subjected to elevated temperatures.

With regards to the aggregate material placed in a CCS, one such material is soil. Soil is any material found in the earth at a locality, which may comprise of naturally derived solids including organic matter, liquids (primarily water), fine to coarse-grained rocks and minerals, and gases (air). The liquids and gases occupy the voids between the solid particles. The packing of soil is known as densification and is achieved during construction by compaction. Compaction is the process in which high load is temporarily applied to the soil by mechanical means such as a roller. When soil is compacted, the solid particles are forced closer together, eliminating any volume in the voids that is occupied by air. Dense soil is rather strong under compression, but has little to no strength under tension. When granular soil is compacted to a dense state, as is required in proper construction, it will reach its peak shear strength under compressive stresses at rather low strain—usually at 1 to 3% strain. However, at larger strains, it will quickly reach lower shear strength than its peak as it undergoes through a strain-softening phenomenon.

The compressive strength and availability of soil makes it desirable as filler for CCSs. When soil is reinforced, such as with a geogrid, a composite structure is formed that is strong under both compression and tension, compared to the original soil.

A CCS contributes to soil strength in several ways. First, the cells of the CCS surround and confine the soil. When a compressive stress is applied to the surface of a geocell infilled with soil, the lateral stress exerted by soil outside the geocell on the cell walls increases as well. The increased soil lateral pressure on the cell walls result in the walls exerting compressive lateral pressure on the soil confined within the cell walls. The increase in the lateral, confining, stress can be as large as the increase in the applied compressive stress. Because the strength of the infill material depends on the lateral stress, an increase in the lateral stress increases the strength of the infill material. In fact, using a stiff cell wall to confine the infill would create a situation where failure of the confined infill will occur only when the solid particles crush or the cell walls undergo large deformation or rupture. As a result, the confined infill exhibits a greater lateral strength for a given depth, compared to unconfined infill.

This principle can be illustrated by soil at various depths. Granular soil at the top of a surface has zero strength at zero confinement so that even weak forces (such as wind) can move the soil particles. Driving a stake into the ground, shearing the soil under compression initially requires little effort. However, trying to drive a stake into the ground gets more difficult the deeper one tries to drive it. The deeper soil is confined because it cannot move laterally and allow shear failure to develop.

In addition, a CCS confines soil, whereas a geogrid does not. As the density of soil in a cell increases, its strength and its stiffness increase dramatically. A thoroughly filled CCS with adequately compacted soil forms a composite structure that, at high enough densities, is analogous to steel reinforced concrete.

To strengthen the interaction between the geocell and the infill, their interface should be rough to maximize frictional resistance and increase the bonding between the two materials. The geocell should also be stiff and creep resistant enough that it will not relax. Relaxation and creep may allow the confined infill to move lateral, resulting in loss of compressive strength.

Unfortunately, creep and relaxation will occur in polyethylene under relatively small loads, such as 10-25% % of its short-term ultimate strength when considering the typical life span of a CCS. Geocells made from polyethylene thus do not perform well over long periods of time because the stress, which increases the strength of the infill, relaxes. Polyethylene is also of limited stiffness (lower than 1 GPa at ambient at 150% per minute strain rate, lower than 600 MPa at temperatures of 40-60° C. at 150% per minute strain rate) and has a high tendency to creep.

Accordingly, it would be beneficial to provide a structure that uses the compressive strength of soil, the tensile strength, stiffness, and dimensional stability of a CCS, and is resistant to dynamic loading.

BRIEF DESCRIPTION

Disclosed in various embodiments, are earth retention systems comprised of various geocells. The earth retention systems have improved resistance against dynamic loads, such as those caused by earthquakes.

In some embodiments, a retaining wall for retaining earth is disclosed, the retaining wall comprising one capping geocell layer and at least one stacking geocell layer;

wherein the capping geocell layer has a greater length than the at least one stacking geocell layer; and wherein the capping geocell layer is located above the at least one stacking geocell layer and at the top of the retaining wall.

The length of the capping geocell layer may be so dimensioned that the ratio of the capping geocell layer length to the height of the retaining wall is at least 0.8.

The retaining wall may further comprise at least one reinforcing geocell layer, the at least one reinforcing geocell layer having a length greater than the at least one stacking geocell layer and less than the capping geocell layer. In specific embodiments, the reinforcing geocell layer may have a stiffness and strength which is about the same as the other geocell layers. In further embodiments, the reinforcing geocell layer may be stiffer and stronger than the other geocell layers.

The ratio of stacking geocell layers to reinforcing geocell layers is from about 1:1 to about 4:1 or from about 2:1 to about 3:1.

The height of the at least one reinforcing geocell layer may be from about one-fifth to the height of the capping geocell layer.

The retaining wall may have a plurality of reinforcing geocell layers, wherein all reinforcing geocell layers have substantially the same length.

The retaining wall may further comprise at least one reinforcing geogrid layer, the at least one reinforcing geogrid layer having a length greater than the at least one stacking geocell layer and shorter than the capping geocell layer.

The ratio of stacking geocell layers to reinforcing geogrid layers is from about 1:1 to about 4:1 or from about 2:1 to about 3:1.

The retaining wall may have a plurality of reinforcing geogrid layers, wherein all reinforcing geogrid layers have substantially the same length.

The retaining wall may have a plurality of stacking geocell layers, wherein all stacking geocell layers have substantially the same length.

The retaining wall may have a plurality of stacking geocell layers, wherein the stacking geocell layers have different lengths.

In other embodiments, a retaining wall for retaining earth is disclosed, the retaining wall comprising one capping geocell layer, at least one reinforcing geocell layer, and at least one stacking geocell layer;

wherein the capping geocell layer has a greater length than the at least one stacking geocell layer;

wherein the capping geocell layer has a greater length than the at least one reinforcing geocell layer;

wherein the at least one reinforcing geocell layer has a greater length than the at least one stacking geocell layer; and wherein the capping geocell layer is located at the top of the retaining wall above the at least one stacking geocell layer and the at least one reinforcing geocell layer.

In still other embodiments, a retaining wall for retaining earth is disclosed, the retaining wall comprising one capping geocell layer, a plurality of reinforcing geocell layers, and a plurality of stacking geocell layers;

wherein the ratio of the length of the capping geocell layer to the height of the retaining wall is at least 0.8;

wherein the capping geocell layer is longer than all reinforcing geocell layers and all stacking geocell layers;

wherein each reinforcing geocell is longer than any stacking geocell; and wherein the capping geocell layer is located at the top of the retaining wall.

The retaining wall may further comprise a foundation geocell layer located at the bottom of the retaining wall.

These and other non-limiting embodiments are described in more detail below.

BRIEF DESCRIPTION OF THE DRAWINGS

The following is a brief description of the drawings, which are presented for the purpose of illustrating the exemplary embodiments disclosed herein and are not for the purpose of limiting the same.

DETAILED DESCRIPTION

The following detailed description is provided so as to enable a person of ordinary skill in the art to make and use the embodiments disclosed herein and sets forth the best modes contemplated of carrying out these embodiments. Various modifications, however, will remain apparent to those of ordinary skill in the art and should be considered as being within the scope of this disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Figure 1:
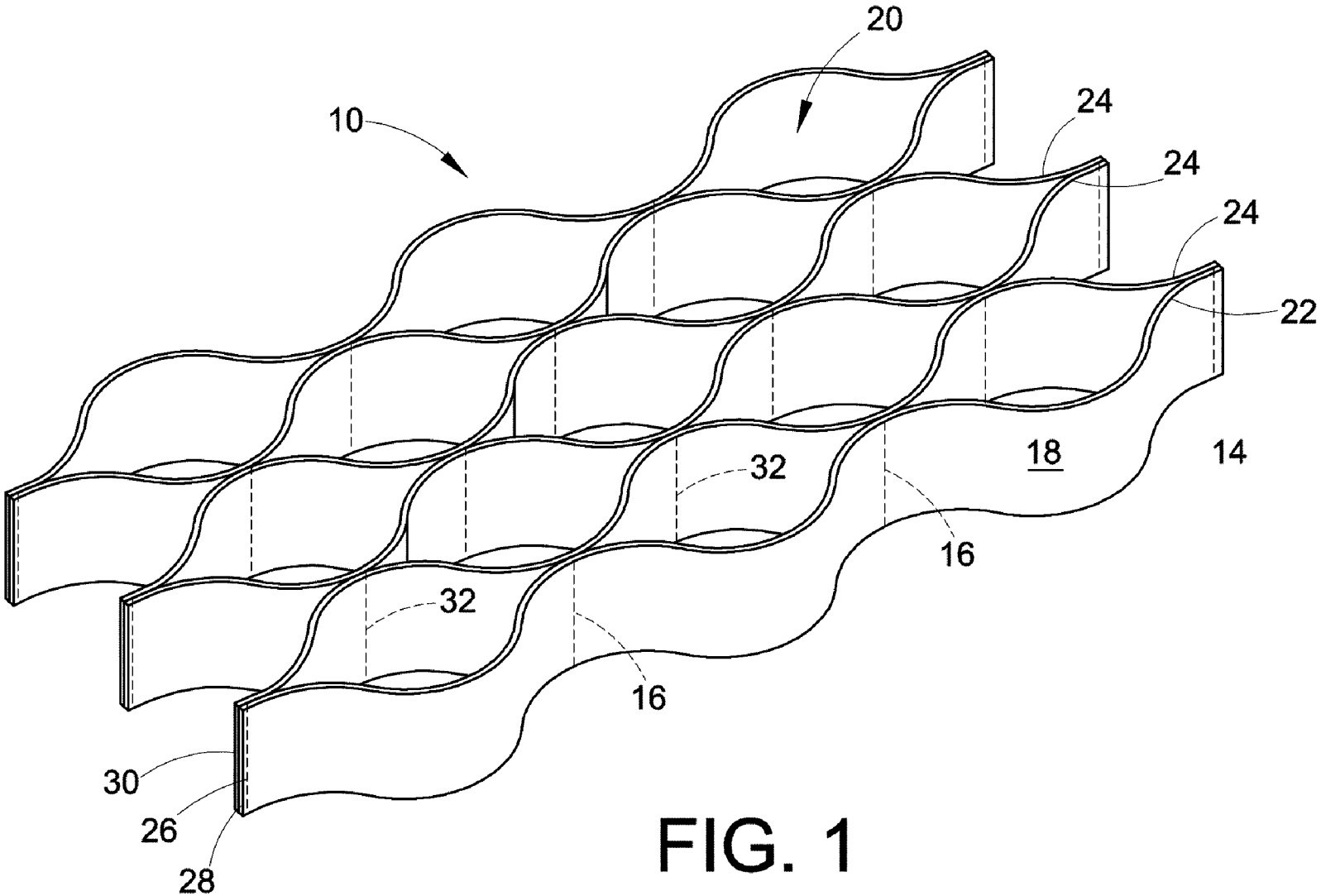
FIG. 1 is a perspective view of a single layer CCS.

FIG. 1 is a perspective view of a single layer CCS. The CCS 10 comprises a plurality of polymeric strips 14. Adjacent strips are bonded together by discrete physical joints 16. The bonding may be performing by gluing, bonding, sewing or welding, but is generally done by welding. The portion of each strip between two joints 16 forms a cell wall 18 of an individual cell 20. Each cell 20 has cell walls made from two different polymeric strips. Each cell in the CCS is generally of the same size. The strips 14 are bonded together to form a honeycomb pattern from the plurality of strips. For example, outside strip 22 and inside strip 24 are bonded together by physical joints 16 which are regularly spaced along the length of strips 22 and 24. A pair of inside strips 24 is bonded together by physical joints 32. Each joint 32 is between two joints 16. As a result, when the plurality of strips 14 is stretched in a direction perpendicular to the faces of the strips, the strips bend in a sinusoidal manner to form the CCS 10. At the edge of the CCS where the ends of two polymeric strips 22, 24 meet, an end weld 26 (also considered a joint) is made a short distance from the end 28 to form a short tail 30 which stabilizes the two polymeric strips 22, 24.

Figure 2:
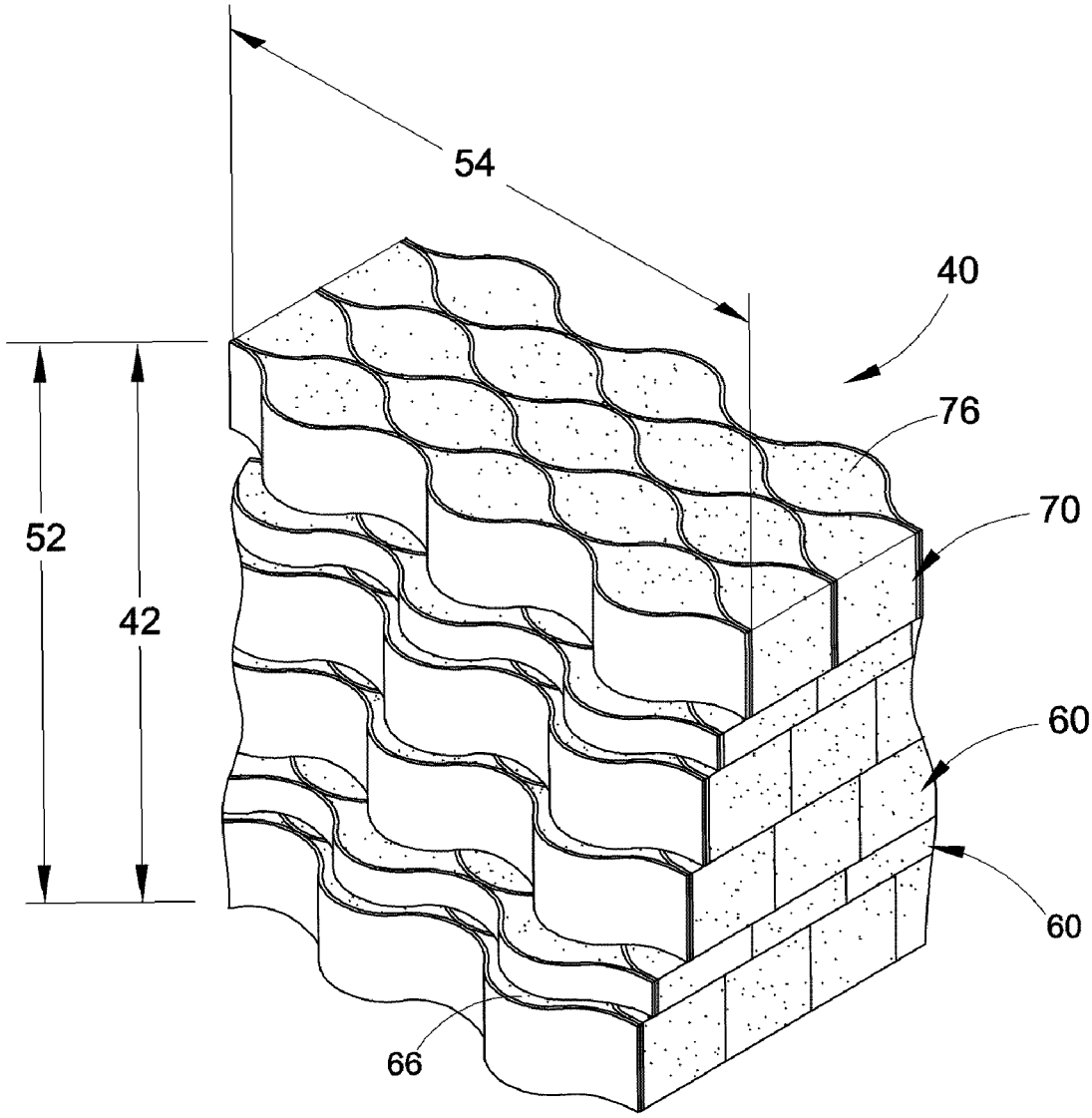
FIG. 2 is a perspective view of a first embodiment of the earth retention system of the present disclosure.

FIG. 2 is a perspective view of a first embodiment of the earth retention system of the present disclosure. The earth retention system 40 retains earth, which may be considered as any organic or mineral material, natural or man-made, that is capable of being retained by such a wall. Exemplary earthen materials include gravel, sand, silt, clay, and the like. The earth may be considered as forming an earthen wall 50 which is retained by the retaining wall built from the earth retention system. The earthen wall has a height 52 and a visible width 54. The retaining wall 40 itself has a height 42 that is generally substantially equal to the earthen wall height 52. The earth retention system includes at least one stacking geocell layer 60. In this Figure, there are several stacking geocell layers. A capping geocell layer 70 is located at the top of the earth retention system 40 so that the top 56 of the earth 50 is substantially level with the top 72 of the capping geocell layer 70. The length 74 of the capping geocell layer 70 is greater than the length 64 of each of the stacking geocell layers. The length of the geocell layers 60, 70 is measured in the direction in which they extend into the earthen wall 50. The length 74 of the capping geocell layer is at least 0.8 times the height 42 of the retaining wall 40. The geocell layers 60, 70 are filled with infill 66, 76, respectively.

Figure 3:
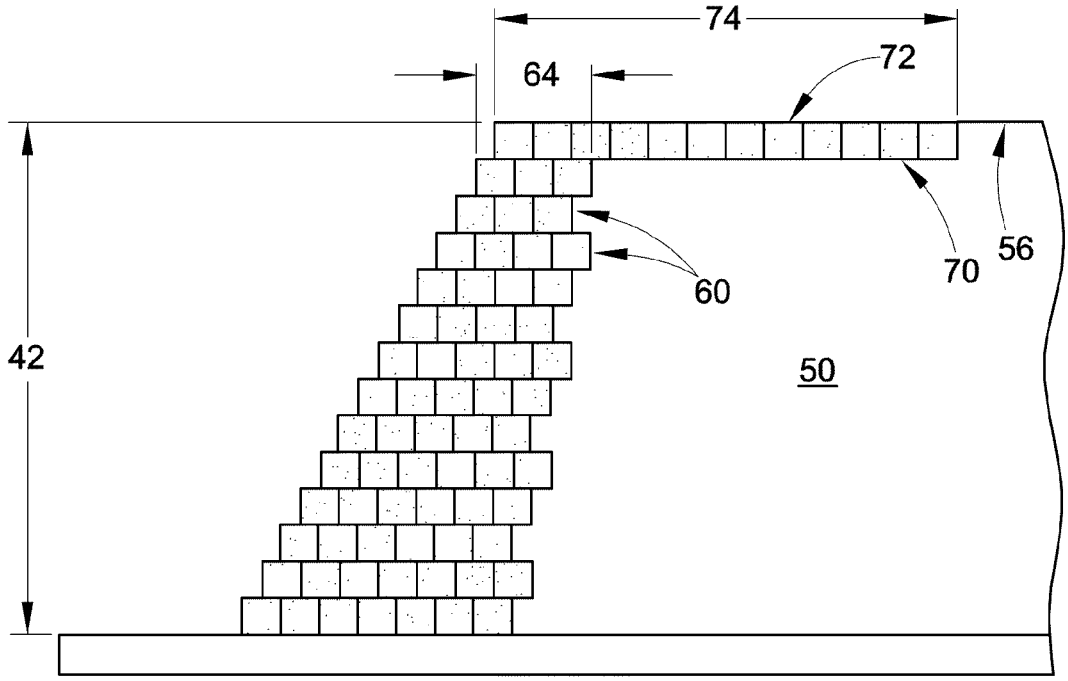
FIG. 3 is a side view of the first embodiment.

FIG. 3 is a side view of the first embodiment shown in FIG. 2. The difference in lengths between the stacking geocell layers 60 and the capping geocell layer 70 is more clearly seen here.

Figure 4:
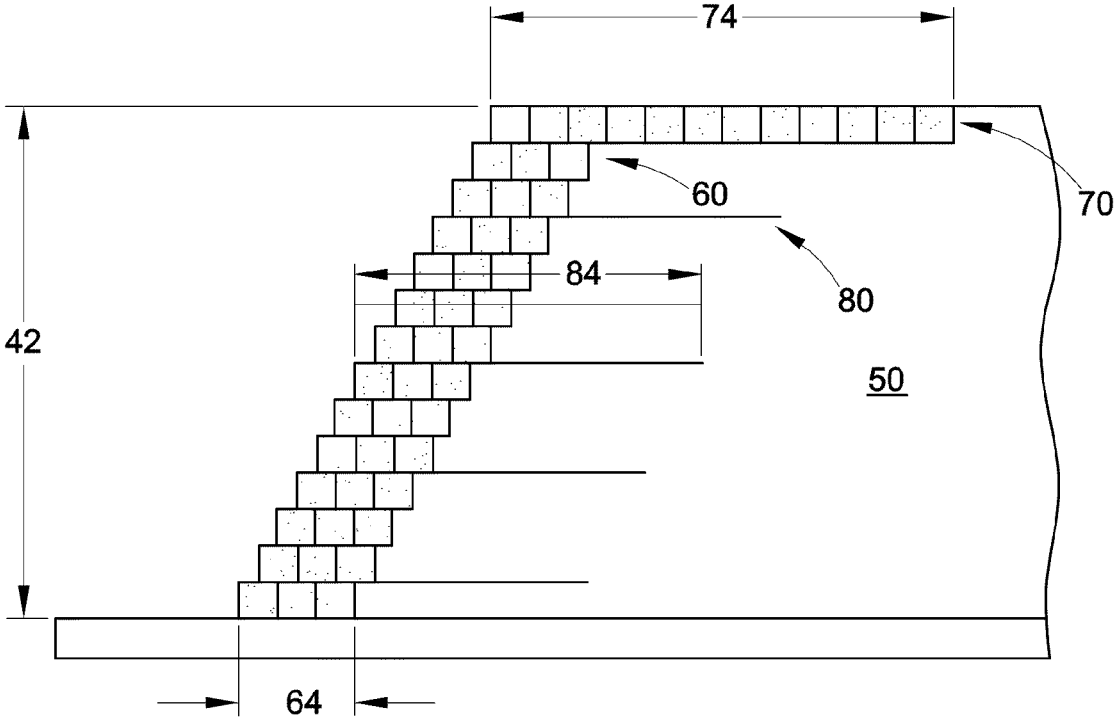
FIG. 4 is a side view of a second embodiment of the earth retention system of the present disclosure.

FIG. 4 is a side view of a second embodiment of the earth retention system of the present disclosure. In this embodiment, the stacking geocell layers 60 are all of the same length. In addition, a reinforcing geogrid layer 80 is embedded between every two stacking geocell layers 60. The reinforcing geogrid layer 80 has a length 84 that is greater than the stacking geocell layer length 64 and less than the capping geocell layer length 74.

Figure 5:
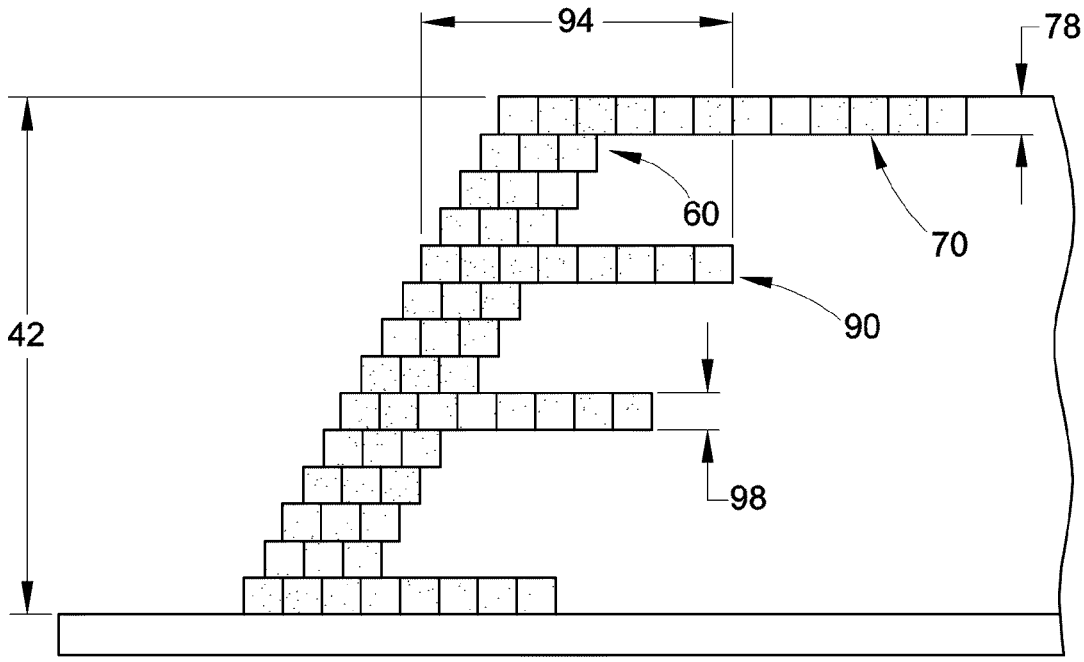
FIG. 5 is a side view of a third embodiment of the earth retention system of the present disclosure.

FIG. 5 is a side view of a third embodiment of the earth retention system of the present disclosure. Here, a reinforcing geocell layer 90 is embedded between every three stacking geocell layers 60. The reinforcing geocell layer 90 has a length 94 that is greater than the stacking geocell layer length 64 and less than the capping geocell layer length 74. The reinforcing geocell layers 90 depicted here have a height 98 that is substantially equal to the height 78 of the capping geocell layer.

Figure 6:
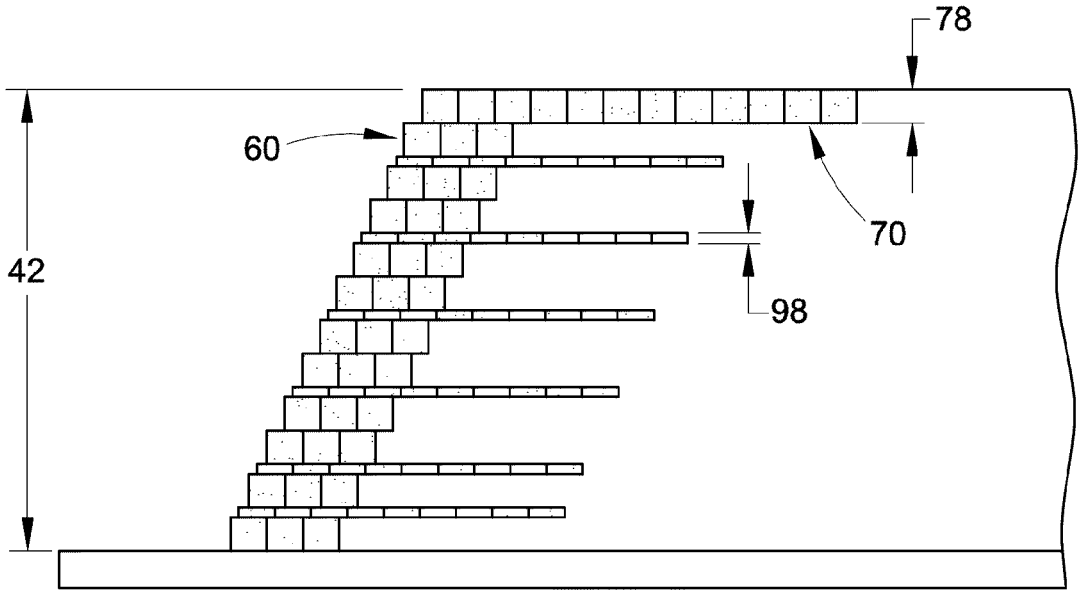
FIG. 6 is a side view of a fourth embodiment of the earth retention system of the present disclosure.

FIG. 6 is a side view of a fourth embodiment of the earth retention system of the present disclosure. The reinforcing geocell layers 90 depicted here have a height 98 that is about one-fourth the height 78 of the capping geocell layer.

Figure 7:
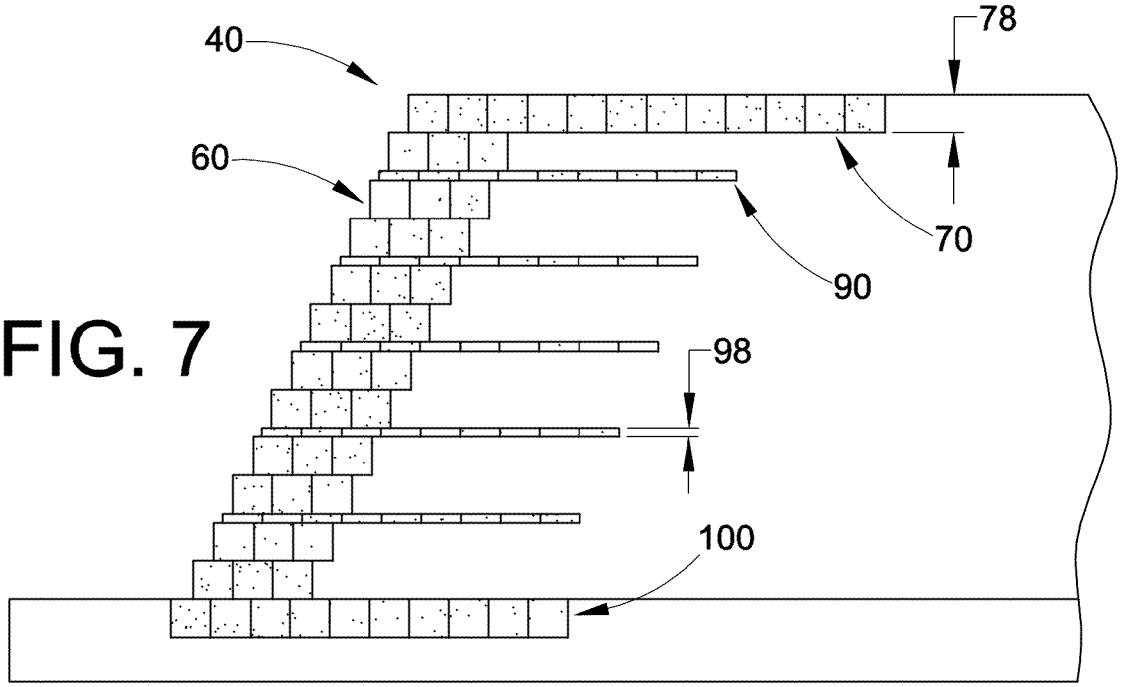
FIG. 7 is a side view of a fifth embodiment of the earth retention system of the present disclosure.

FIG. 7 is a side view of a fifth embodiment of the earth retention system of the present disclosure. Here, a foundation geocell layer 100 is placed in the foundation soil beneath the earthen wall 50. The stacking geocell layers 60 are located between the foundation geocell layer 100 and the capping geocell layer 70. The length 104 of the foundation geocell layer is greater than the stacking geocell layer length 64 and less than the capping geocell layer length 74 as well.

The earth retention system of the present disclosure has increased stability against dynamic loads, such as those caused from seismic activity like earthquakes. It also resists deterioration from vibrations better than conventional retaining walls. One aspect of this increased stability derives from the polymeric nature of the geocells. Concrete structures, such as gravity retaining walls and reinforced concrete slabs, are rigid and brittle. Thus, when subjected to vibrations like those generated by earthquakes, they sustain and transfer the vibrations with little attenuation or even amplify the load. The flexible geocells, on the other hand, are characterized by a ductile stress-strain response. They serve as dampers, absorbing and dissipating the dynamic energy.

The capping geocell layer enhances the stability of the retaining wall. It was discovered that a long capping geocell layer inhibits crack formation and slip surface formation in the earth beneath it. This increases the stability of the retaining wall by inhibiting the formation of cracks or slip surfaces near the face of the retaining wall. It also reduces the lateral earth pressure acting on the face of the wall. In particular, if cracks or slip surfaces do form, they generally form behind the capping geocell layer and the cracks or slip surfaces run into the ground, rather than into the face of the retaining wall. This reduces the potential for translational or rotational failure of the retaining wall.

In embodiments, the capping geocell layer is located so that the top of the capping geocell layer is substantially level with the top of the earthen wall it is retaining. The length of the capping geocell layer is so dimensioned that the ratio of the capping geocell layer length to the height of the retaining wall is at least 0.8. In specific embodiments, the ratio is from at least 0.8 to about 1.0 and in further specific embodiments the ratio is from about 0.9 to about 1.0.

The reinforcing geogrid layers and reinforcing geocell layers also aid in stabilizing the earth behind the retaining wall. In particular, geogrid layers have been previously used to stabilize the fill behind the retaining wall. Reinforcing geocell layers, besides simply stabilizing the fill, also provide increased stability against dynamic loading. In this regard, seismic waves, such as from earthquakes, typically cause the earth to move up and down, as well as from side to side. While a geogrid can stabilize earth moving side to side, it minimally affects the up-and-down motion. However, geocells, unlike geogrids, are three-dimensional. Because geocells contain infilled soil, they also have bending moment resistance and shear resistance. These additional properties, which are lacking in geogrids, allow the reinforcing geocells to absorb and dissipate energy from the up-and-down motion as well. The reinforcing geogrid layers and geocell layers also aid in resisting rotational and translational failure.

The reinforcing geogrid layers and geocell layers have a length that is greater than any of the stacking geocell layers and is less than the length of the capping geocell layer. In embodiments, the length of the reinforcing geogrid layers and geocell layers are from about 0.6 to about 0.7 times the height of the retaining wall. The ratio of the height of the reinforcing geocell layers to the height of the capping geocell layer is from about one-fifth to one. In embodiments having multiple reinforcing geogrid layers or geocell layers, the lengths may vary between the reinforcing geogrid layers, but all of them are longer than the stacking geocell layers and shorter than the capping geocell layer. In embodiments having multiple reinforcing geocell layers, the heights may also vary, but all of them are from about one-fifth to about the height of the capping geocell layer. Generally, for purposes of simplicity, when there are multiple reinforcing geogrid layers or geocell layers, their lengths and/or heights are substantially the same.

The stacking geocell layers can vary in length, as seen in the Figures. In specific embodiments having a plurality of multiple stacking geocell layers, they all have substantially the same lengths. Generally, they are all of the same height as well, though they may vary if desired. Typically, the stacking geocell layer is a minimum of three cells in depth (i.e. about 0.6 meters).

The ratio of stacking geocell layers to reinforcing geocell layers is from about 1:1 to about 4:1. In more specific embodiments, the ratio is from about 2:1 to about 3:1. The same ratio is followed for reinforcing geogrid layers as well.

Some embodiments may further comprise a foundation geocell layer. The length of the foundation geocell layer is greater than the stacking geocell layer length. In some embodiments, the foundation geocell layer length is also less than the capping geocell layer length. The foundation geocell layer increases the bearing capacity of the foundation soil and reduces settlement of the earth retention system. It also serves as a leveling pad for the geocell layers above it and provides for drainage.

Figure 8:
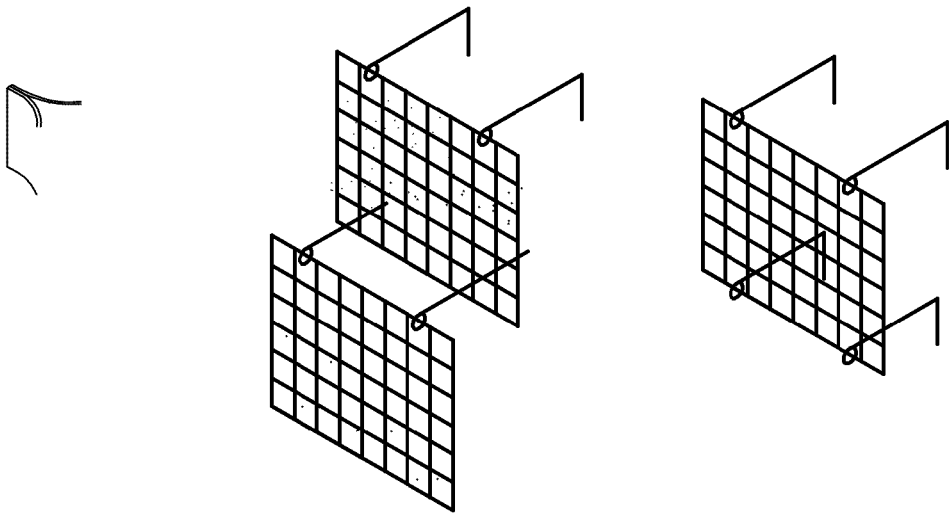
FIG. 8 is a perspective view of a retaining wall including a facade.

If desired, the earth retention system may further comprise at least one facade. When emplaced, the ends of the geocells making up the retaining wall are generally exposed. The polymeric material making up the geocells may not be aesthetically pleasing. Exposure of the polymeric material to sunlight can also cause UV degradation of the material and/or cause creep, shortening the useful life of the retaining wall. It may also be susceptible to vandalism or fire. Use of a facade can reduce all of these problems. One example of a facade can be seen in FIG. 8. Here, the facade comprises a wire mesh and a pair of top and bottom anchors to hold the mesh in place. The anchors have an L shape and are inserted into the infill of the geocell layer. The top anchors may be longer than the bottom anchors. In other embodiments, the facade is a wire mesh having an L shape. One part of this wire mesh can be placed between stacked geocell layers. The space between the wire mesh and the end of the geocell can then be filled with a decorative and/or durable material, such as gravel, crushed rock, etc. The facade may have a height sufficient to cover multiple layers of the retaining wall at a time. In other words, it can have a height equal to a plurality of stacking geocell layers and/or reinforcing geocell layers.

The number of geocell layers should not be considered as requiring each layer to be made from only one geocell. Each layer of the retaining wall may be made from a large number of individual geocell layers over the width of that particular layer, and multiple geocells in a particular layer should be construed as just one geocell layer. For example, FIG. 5 should be construed as having one capping geocell layer, ten stacking geocell layers (of equal length), and three reinforcing geocell layers.

The term "retaining wall" should be understood as referring to the structure that results from the stacking of the various geocell layers to form an earth retention system. Some international standards define a "retaining wall" as having a batter (or slope) of less than 20°; however, that definition is not applicable to this disclosure. The retaining walls of the present disclosure may also have a slope of greater than 20°.

The geocells in the geocell layers may be made from a fiber reinforced thermoplastic polymer, an alloy or blend of polyolefin and engineering thermoplastics, polyamide, polyester, or multi-layered polymers, such as multilayer PE-polyamide or PE-polyester. The composition that makes up the geocells may have a tensile elastic modulus at a strain rate of 10% per minute of at least 0.8 GPa, a tensile strength at a strain rate of 10% per minute of at least 10 MPa, and creep deformation of at most 20% when loaded at 50% of its yield stress for 500 hours at 23° Celsius. In specific embodiments, the composition has a tensile elastic modulus at a strain rate of 10% per minute of at least 1 GPa, a tensile strength at a strain rate of 10% per minute of at least 15 MPa, and creep deformation of at most 15% when loaded at 50% of its yield stress for 500 hours at 23° C. These compositions are suitable for all of the geocell layers, and especially for the reinforcing geocell layers.

The following examples are provided to illustrate the earth retention systems and methods of the present disclosure. The examples are merely illustrative and are not intended to limit compositions made in accordance with the disclosure to the materials, conditions, or process parameters set forth therein.

EXAMPLES

Example 1

Two compositions suitable for use in the geocells were made and compared to high density polyethylene (HDPE).

Composition A: PE alloy with improved creep resistance 5 kg of HDPE grafted with 1% maleic anhydride was melt kneaded with 5 kg of dry polyamide 6 resin in a co-rotating twin screw extruder having L/D of 48, at 280° C., 150 RPM, to provide a PE alloy. The alloy was melt kneaded by a single screw extruder at 260° C., through a flat die and calendars, to form an embossed strip having average thickness of 1.2 mm.

An HDPE strip having the same dimensions and a density of 0.941 g/cm$^3$ was also extruded for comparison. The mechanical properties and creep properties were analyzed and are shown in Table 1.

TABLE 1

| Description | Alloy | HDPE |
|---|---|---|
| Tensile stress at yield, strain rate of 10 mm/min (MPa) | 29 | 13 |
| Tensile modulus at 1% deformation, strain rate of 10 mm/min (MPa) | 1350 | 550 |
| Deformation when loaded under 50% of stress to yield, 500 hours at 23° C. (additional % of original dimension) | 8 | 300 |
| Stress to rupture when loaded under 50% of stress to yield, 500 hours at 23° C. (MPa) | 25 | 7 |

Composition B: PE composite with improved creep resistance

HDPE having a density of 0.941 g/cm$^3$ was melt kneaded by a single screw extruder at 260° C. and extruded through a flat die, wherein glass fiber roving was fed to the melt, to provide a continuous fiber reinforced composite strip. The weight percentage of fibers was set to 15% of the strip weight. The melt was calendared to form an embossed strip having average thickness of 1.2 mm.

An HDPE strip having the same dimensions and a density of 0.941 g/cm$^3$ was also extruded for comparison. The mechanical properties and creep properties were analyzed and are shown in Table 2.

TABLE 2

| Description | Composite | HDPE |
|---|---|---|
| Tensile stress at yield, strain rate of 10 mm/min (MPa) | 22 | 13 |

TABLE 2-continued

| Description | Composite | HDPE |
|---|---|---|
| Tensile modulus at 1% deformation, strain rate of 10 mm/min (MPa) | 1100 | 550 |
| Deformation when loaded under 50% of stress to yield, 500 hours at 23° C. (additional % of original dimension) | 6 | 300 |
| Stress to rupture when loaded under 50% of stress to yield, 500 hours at 23° C. (MPa) | 17 | 7 |

Example 2

Experiments were performed using a shake table at the Japan National Research Institute of Agricultural Engineering in Tsukuba City, Japan. The shake table was 6 meters by 4 meters and, at maximum payload, had a maximum horizontal/vertical acceleration of 1 g. A steel box 2 meters wide, 4 meters long, and 3 meters high was placed inside a larger box having transparent walls, then placed on the shake table. Various retaining walls were built inside the test box.

A fine, uniform sand, originally obtained from Tokachi Port in Hokkaido, was used as the backfill (the earthen material to be retained). The sand had a mean diameter of 0.27 millimeters, a uniformity coefficient of 2, a specific gravity of 2.668, and a fines content of 0.35%. The sand was compacted to a unit weight of 90% Proctor density. The sand had an average dry unit weight of 14.3 kN/m$^3$. The internal angle of friction for the sand was measured and found to be 38°.

A foundation layer of 20 cm height was formed from the sand. The retaining walls were built on top of the foundation layer from blocks.

Several strain gauges, force transducers, accelerometers, and displacement transducers were used to measure various aspects of the reaction of the backfill and the retaining wall.

Gravel was used as infill in some of the tested retaining walls. The gravel was a standard Japanese commercial product, designated as M30, which had a mean diameter of 6 mm and a maximum grain size of 30 mm. The average unit weight of the gravel in the tests was 20.1 kN/m$^3$. The gravel had an internal angle of friction that was not directly measured, but was likely greater than 45°.

The retaining walls were then subjected to a horizontal and/or vertical motion to simulate an earthquake. The 1995 Kobe, Japan earthquake was used as a baseline. In Kobe, the horizontal acceleration ranged up to 0.8 g and the vertical acceleration ranged up to 0.4 g.

Five retaining walls according to the present disclosure were built. They were constructed from geocells formed by heat bonding or welding polypropylene sheets of thickness 2 mm together. When stretched, each cell was of dimensions approximately 20 cm by 20 cm; upon compaction, the dimensions increased to 21 cm by 21 cm. Nominal height was 20 cm. The geocells were textured to allow for a better interaction with the fill material and perforated to allow for horizontal drainage. Each layer was placed at an offset of 10 cm from the layer below it, for a slope of 63.4°.

White thin seams of sand were placed every about 40 cm within the backfill material. This white sand layer had negligible effects on the wall behavior. Upon completion of each test, the slope was carefully excavated to observe dislocations of these seams so that traces of slip surfaces could be identified.

Example Wall 1

Example Wall 1 was constructed as seen in FIG. 3. The total height of the wall was 2.8 meters (14 layers). The bottom stacking geocell layer had a length of seven cells, or about 1.47 meters. The stacking geocell layers tapered to a top stacking geocell layer having a length of three cells. The capping layer had a length of 12 cells, or about 2.52 meters. M30 gravel was used as the infill for all of the geocell layers.

Example Wall 2

Example Wall 2 was constructed as seen in FIG. 4. The total height of the wall was 2.8 meters (14 layers). All of the stacking geocell layers had a length of three cells. The capping layer had a length of 12 cells, or about 2.52 meters. M30 gravel was used as the infill for all of the geocell layers.

In addition, six geogrid layers were used. The first geogrid layer was placed 20 cm above the foundation layer and the rest were subsequently spaced apart by 40 cm. The geogrid layer was a polyester Fortrac® geogrid layer (made by Huesker) with apertures of 2 cm by 2 cm. The geogrid layer had a $T_{ult}$ of 35 kN/m at 10% elongation. The length of each geogrid layer was 180 cm (L/H=0.64), measured from the front end of the geocell layer. The geogrid layer thus extended 1.17 m beyond the geocell layer.

Example Wall 3

Example Wall 3 was constructed the same as Example Wall 1, except that sand was used as the infill for the geocell layers instead of M30 gravel.

Example Wall 4

Example Wall 4 was constructed as seen in FIG. 5. The total height of the wall was 2.8 meters (14 layers). The stacking geocell layers had a length of three cells. The capping layer had a length of 12 cells, or about 2.52 meters. In addition, three reinforcing geocell layers with a length of eight cells and a height of 20 cm were used. The first reinforcing geocell layer was located directly on the foundation layer, the second 80 cm above the first, and the third 60 cm above the second. Sand was used as the infill for all of the geocell layers.

Example Wall 5

Example Wall 5 was constructed as seen in FIG. 6. The total height of the wall was 2.7 meters. The stacking geocell layers had a length of three cells. The capping layer had a length of 12 cells, or about 2.52 meters. In addition, six reinforcing geocell layers with a length of nine cells and a height of 5 cm were used. Each reinforcing geocell layer was set back from the stacking geocell layer under it by 5 cm. M30 gravel was used as infill for the capping geocell layer and stacking geocell layers. For the reinforcing geocell layers, the front three cells (lying between stacking geocell layers) were infilled with M30 gravel and the rear six cells (extending into the backfill) were infilled with sand.

Shake Tests

The test walls were then subjected to two-dimensional shaking on the shake table.

For Example Walls 1 and 3, the excitation was applied in two stages. The target excitation was a horizontal peak ground acceleration (PGA) of 0.4 g and vertical PGA=0.2 g. Following a relaxation period of about one hour, the target excitation amplitude in the second stage was horizontal PGA=0.8 g and vertical PGA=04 g.

For Example Walls 2, 4 and 5, three loading stages were used. The target horizontal PGA was 0.4 g, 0.8 g, and 1.2 g, for the first, second, and third stages, respectively. The target vertical PGA was 0.2 g, 0.4 g, and 0.5 g for the first, second, and third stages, respectively. The relaxation period between each excitation in Tests 2, 4 and 5 was about one hour. However, due to limits in the actuators used to generate the accelerations, the actual accelerations applied were not exactly equal to the target values and were not completely uniform between all five Example Walls. Table 3 shows the applied PGA as recorded by accelerometers installed on the base of the table for each test and loading stage. The variations between Example Walls at each stage were not believed to be significant.

TABLE 3

| Applied PGA | | | | | | |
|---|---|---|---|---|---|---|
| | Applied Peak Acceleration at Base of Shake Table | | | | | |
| Example | Horizontal PGA at Each Loading Stage | | | Vertical PGA at Each Loading Stage | | |
| Wall | 1 | 2 | 3 | 1 | 2 | 3 |
| 1 | 0.46 g | 0.92 g | — | 0.21 g | 0.42 g | — |
| 2 | 0.46 g | 0.94 g | 1.21 g | 0.20 g | 0.39 g | 0.47 g |
| 3 | 0.48 g | 0.94 g | — | 0.20 g | 0.39 g | — |
| 4 | 0.47 g | 0.95 g | 1.22 g | 0.20 g | 0.37 g | 0.48 g |
| 5 | 0.41 g | 0.87 g | 1.21 g | 0.18 g | 0.34 g | 0.50 g |

Results

Test Walls 1 and 3 are compared with each other because their only difference was the infill material (gravel for Wall 1 vs. sand for Wall 3).

Figure 9:
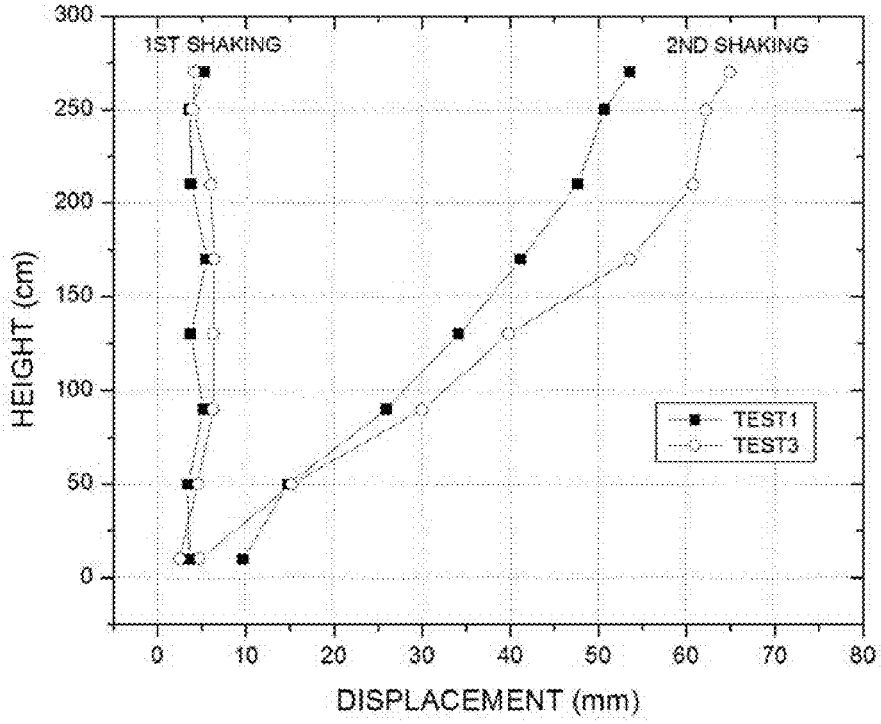
FIG. 9 is a graph showing the amount of horizontal displacement versus height of various retaining walls.
Figure 10:
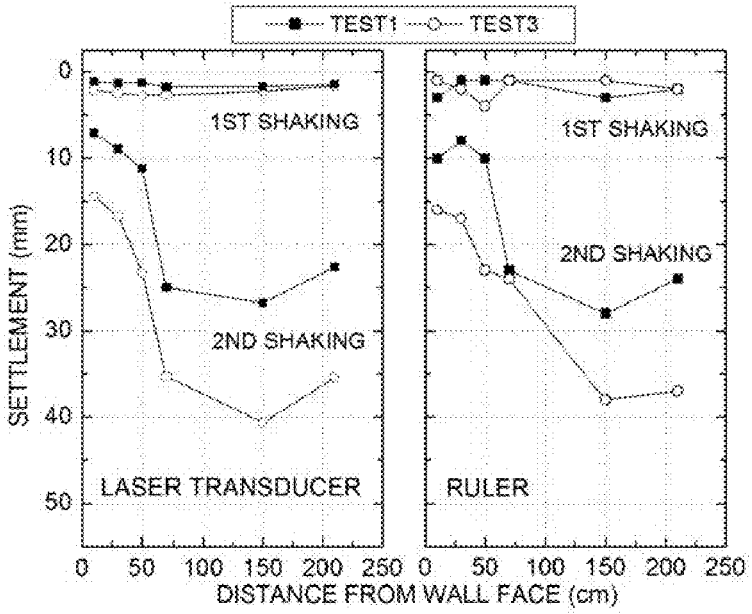
FIG. 10 is a graph showing the amount of crest settlement versus distance from the face of various retaining walls.
Figure 11:
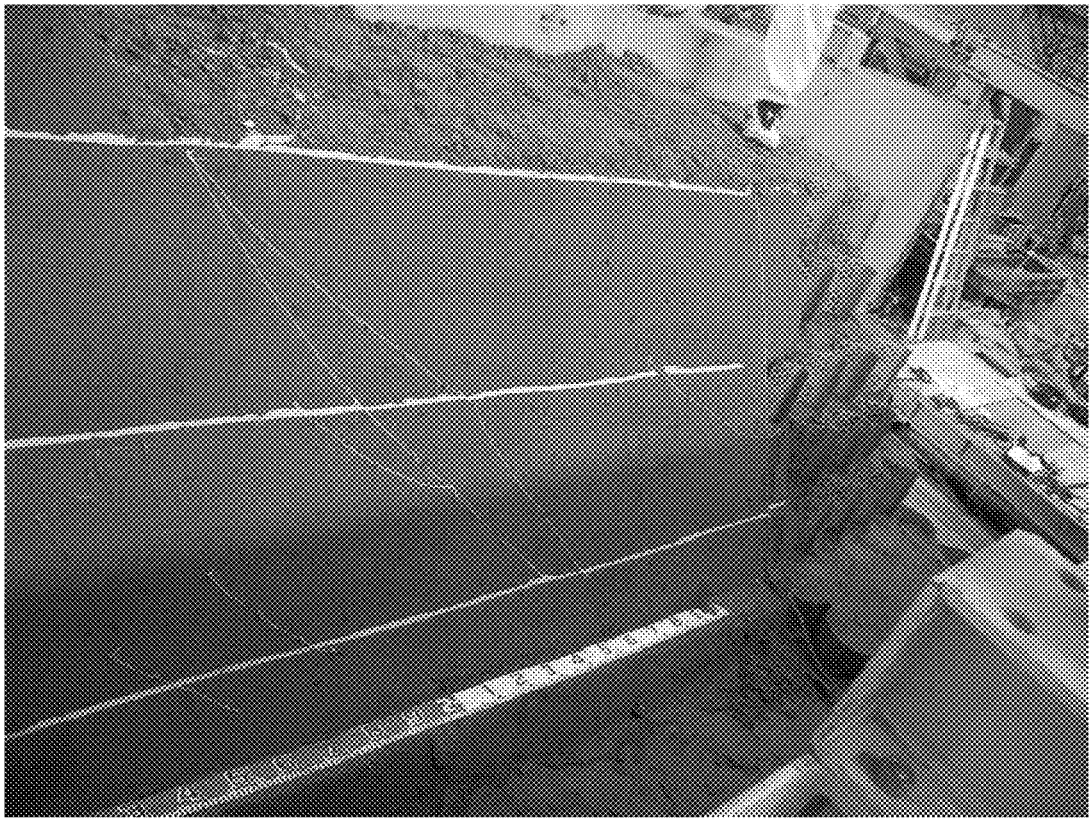
FIG. 11 is a picture of the side of Example Wall 1.
Figure 12:
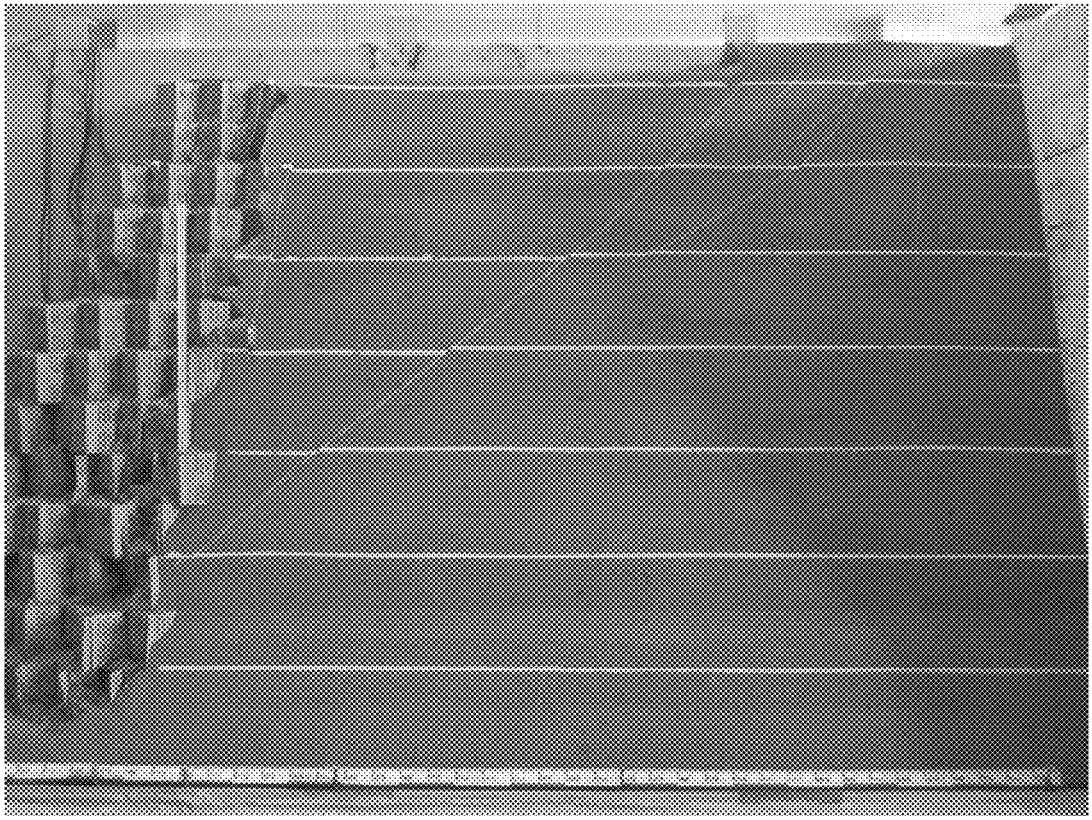
FIG. 12 is a picture of the side of Example Wall 3.

FIG. 9 is a graph showing the amount of horizontal displacement versus height of the retaining wall for Walls 1 and 3. FIG. 10 is a graph showing the amount of crest settlement versus distance from the face of the retaining wall for Walls 1 and 3. FIG. 11 is a picture of the side of Example Wall 1 after shaking. FIG. 12 is a picture of the side of Example Wall 3 after shaking.

Figure 13:
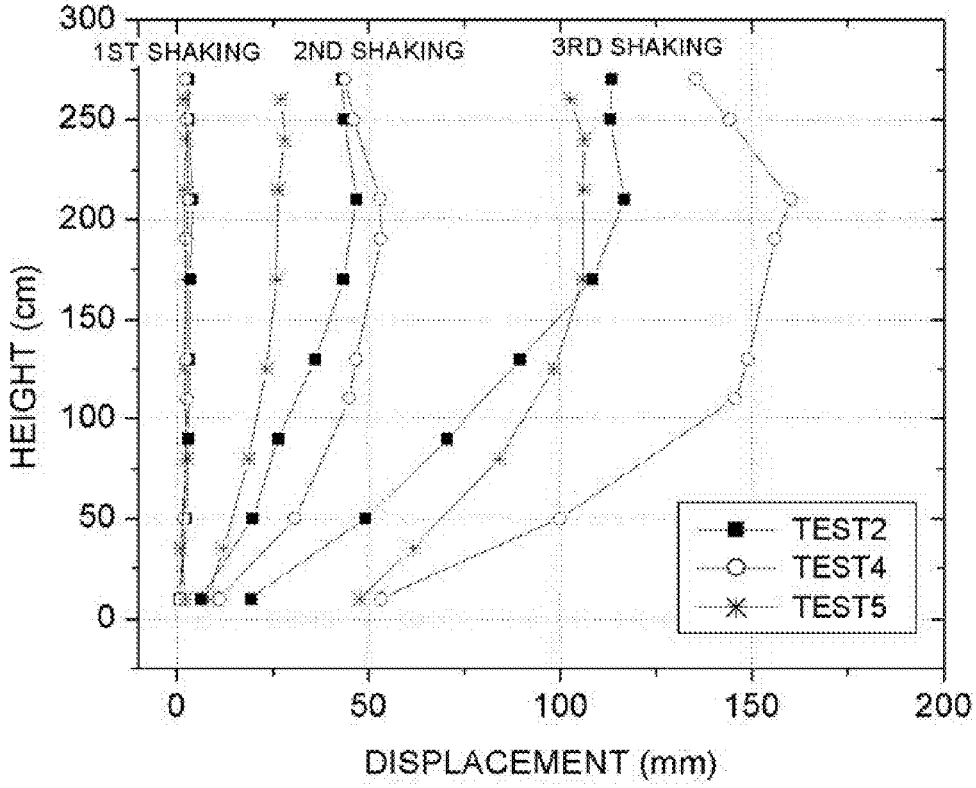
FIG. 13 is a graph showing the amount of horizontal displacement versus height of the retaining wall for Example Walls 2, 4, and 5.
Figure 14:
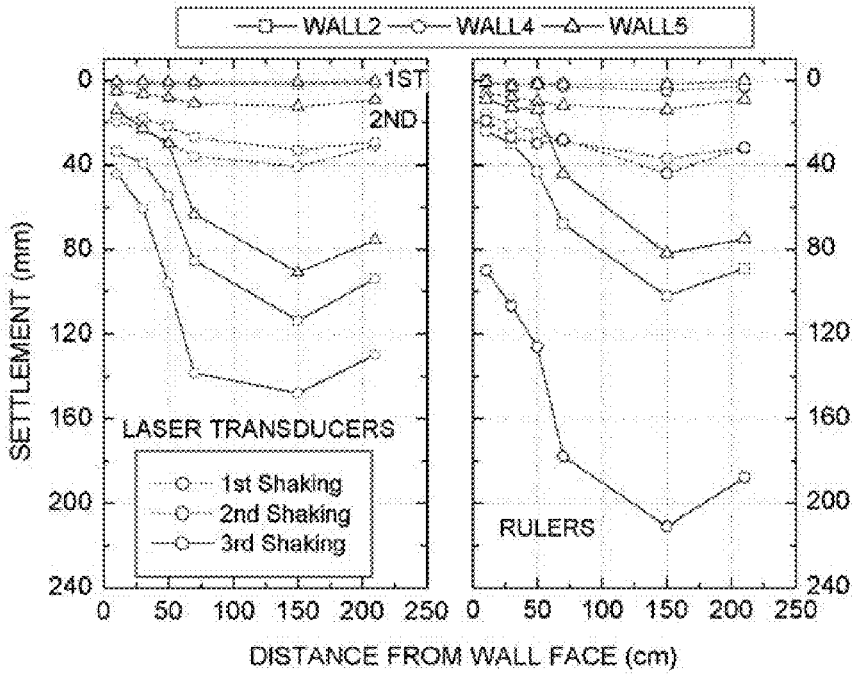
FIG. 14 is a graph showing the amount of crest settlement versus distance from the face of the retaining wall for Example Walls 2, 4, and 5.
Figure 15:
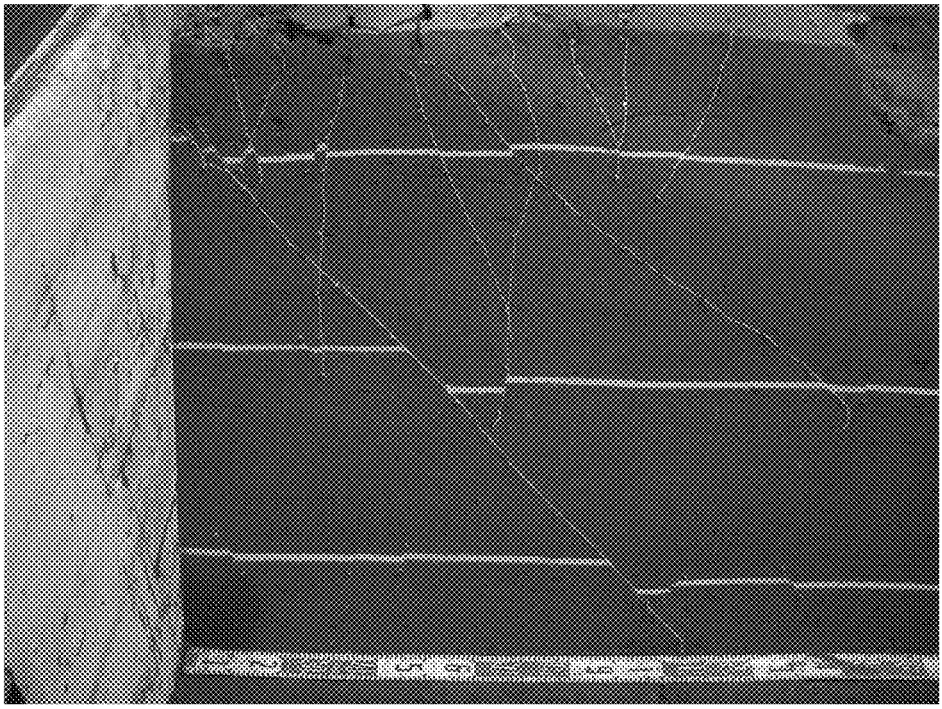
FIG. 15 is a picture of the side of Example Wall 2.
Figure 16:
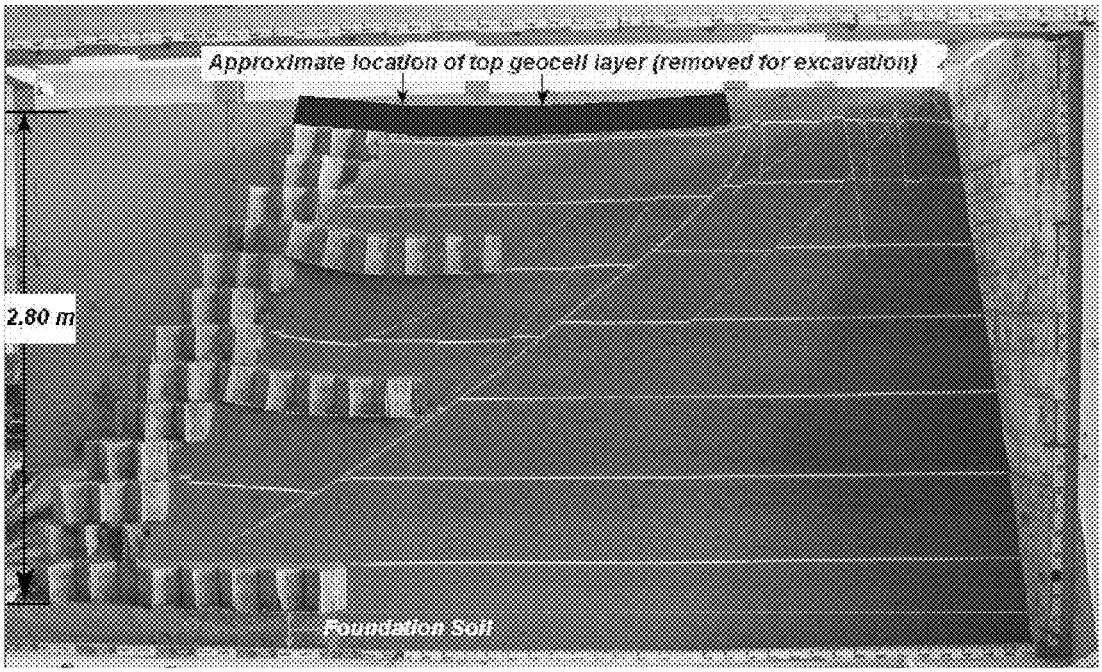
FIG. 16 is a picture of the side of Example Wall 4.
Figure 17:
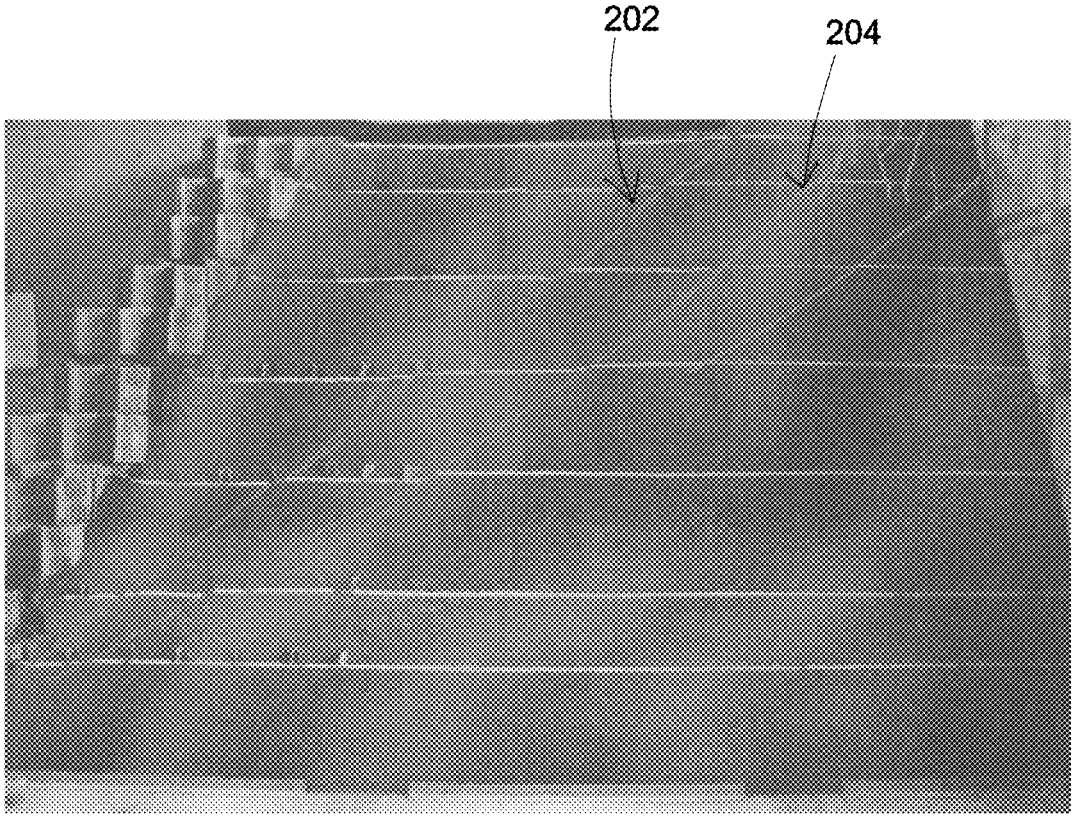
FIG. 17 is a picture of the side of Example Wall 5.

FIG. 13 is a graph showing the amount of horizontal displacement versus height of the retaining wall for Walls 2, 4, and 5. FIG. 14 is a graph showing the amount of crest settlement versus distance from the face of the retaining wall for Walls 2, 4, and 5. FIG. 15 is a picture of the side of Example Wall 2 after shaking. FIG. 16 is a picture of the side of Example Wall 4 after shaking. FIG. 17 is a picture of the side of Example Wall 5 after shaking.

Table 4 lists the maximum permanent displacements and maximum permanent crest settlements for the five walls.

TABLE 4

| Example Wall | Face Maximum Permanent Horizontal Displacement (mm) | Crest Maximum Permanent Settlement (mm) |
|---|---|---|
| 1 | 31 | 27 |
| 3 | 47 | 40 |
| 2 | 95 | 115 |
| 4 | 150 | 150 |
| 5 | 95 | 85 |

Discussion of Example Walls 1 and 3

Example Wall 1 performed better than Example Wall 3. The face of Wall 1 had a maximum permanent displacement of less than 31 mm and a crest maximum permanent settlement of less than 27 mm. In contrast, these values for Wall 3 were 47 mm and 40 mm, respectively.

Comparing FIGS. 11 and 12, Wall 1 had no fully developed slip surfaces, whereas a slip surface was present in Example Wall 3. This appeared to represent a translational movement that terminated at about 40 cm above the foundation layer. The slip surface was not associated with a catastrophic failure; a wall supporting a soil wedge defined by the slip surface is considered operational.

Discussion of Example Walls 2, 4 and 5

As seen in FIG. 15, no slip surface was seen in Wall 2, only some shallow discontinuities. As seen in FIG. 16, a slip surface developed in Wall 4. This appeared to be a rotational arc. Again, however, this was not associated with a catastrophic failure; note that Wall 4 received 205% of the Kobe earthquake's maximum horizontal acceleration. As seen in FIG. 17, Wall 5 had two continuous rotational slip surfaces 202, 204. It is likely that the shallower one 202 developed first while the deeper one 204 was a secondary failure as shaking continued. In particular, the shallower surface passed through four reinforcing geocell layers. This meant the 0.05 m high reinforcing geocell layers deformed and bent sufficiently to allow the slip surface to continue propagating. However, the overall retaining wall did not fail. This indicated that the reinforcing geocell layers effectively contributed to stability (i.e., they were not excessively strong and not excessively weak). Both the shear strength of the soil and the tensile resistance of the geocell layer were mobilized. Without the reinforcing geocell layers, the wall would very likely have collapsed because the stacking geocell layers were not deep enough to support the retained soil mass.

Although Walls 4 and 5 had slip surfaces, it should be noted that all of the slip surfaces were initiated beyond the capping geocell layer. As a result, the slip surfaces intersected the face of the retaining wall near the base of the retaining wall and exerted a lower load. Because of the additional weight of the geocell layers and infill above the base, those slip surfaces did not destabilize the retaining wall. In contrast, without a capping geocell layer, more critical slip surfaces could be initiated thus exerting higher lateral loads on the face of the retaining wall, possibly causing collapse. Allowing only deeper slip surfaces to develop reduced the lateral load against the face of the retaining wall, compared to critical slip surfaces which would develop without a capping geocell layer serving to constrain them.

Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A retaining wall for retaining earth, the retaining wall comprising one capping geocell layer, at least one stacking geocell layer, and at least one reinforcing geocell layer;

wherein the capping geocell layer has a greater length than the at least one stacking geocell layer;

wherein the capping geocell layer is located above the at least one stacking geocell layer and at the top of the retaining wall;

wherein the at least one reinforcing geocell layer has a length greater than the at least one stacking geocell layer and less than the capping geocell layer;

wherein the length of the capping geocell layer is so dimensioned that the ratio of the capping geocell layer length to the height of the retaining wall is at least 0.8; and wherein the ratio of stacking geocell layers to reinforcing geocell layers is from about 2:1 to about 3:1.

2. A retaining wall for retaining earth, the retaining wall comprising one capping geocell layer, at least one stacking geocell layer, and at least one reinforcing geocell layer;

wherein the capping geocell layer has a greater length than the at least one stacking geocell layer;

wherein the capping geocell layer is located above the at least one stacking geocell layer and at the top of the retaining wall;

wherein the at least one reinforcing geocell layer has a length greater than the at least one stacking geocell layer and less than the capping geocell layer;

wherein the length of the capping geocell layer is so dimensioned that the ratio of the capping geocell layer length to the height of the retaining wall is at least 0.8; and wherein the ratio of the height of the at least one reinforcing geocell layer to the height of the capping geocell layer is from about one-fifth to one.

3. A retaining wall for retaining earth, the retaining wall comprising one capping geocell layer, at least one stacking geocell layer, and at least one reinforcing geogrid layer;

wherein the capping geocell layer has a greater length than the at least one stacking geocell layer;

wherein the capping geocell layer is located above the at least one stacking geocell layer and at the top of the retaining wall;

wherein the length of the capping geocell layer is so dimensioned that the ratio of the capping geocell layer length to the height of the retaining wall is at least 0.8;

wherein the at least one reinforcing geogrid layer has a length greater than the at least one stacking geocell layer and shorter than the capping geocell layer; and wherein the ratio of stacking geocell layers to reinforcing geogrid layers is from about 2:1 to about 3:1.

4. The retaining wall of claim 3, having a plurality of reinforcing geogrid layers, wherein all reinforcing geogrid layers have substantially the same length.

5. A retaining wall for retaining earth, the retaining wall comprising one capping geocell layer, at least one reinforcing geocell layer, and at least one stacking geocell layer;

wherein the capping geocell layer has a greater length than the at least one stacking geocell layer;

wherein the capping geocell layer has a greater length than the at least one reinforcing geocell layer;

wherein the at least one reinforcing geocell layer has a greater length than the at least one stacking geocell layer;

wherein the capping geocell layer is located above the at least one stacking geocell layer and the at least one reinforcing geocell layer at the top of the retaining wall;

wherein the length of the capping geocell layer is so dimensioned that the ratio of the capping geocell layer length to the height of the retaining wall is at least 0.8; and wherein the ratio of the height of the at least one reinforcing geocell layer to the height of the capping geocell layer is from about one-fifth to one.

6. The retaining wall of claim 5, having a plurality of stacking geocell layers, wherein all stacking geocell layers have substantially the same length.

7. The retaining wall of claim 5, having a plurality of reinforcing geocell layers, wherein all reinforcing geocell layers have substantially the same length.

8. A retaining wall for retaining earth, the retaining wall comprising one capping geocell layer, a plurality of reinforcing geocell layers, and a plurality of stacking geocell layers;

wherein the ratio of the length of the capping geocell layer to the height of the retaining wall is at least 0.8;

wherein the capping geocell layer is longer than all reinforcing geocell layers and all stacking geocell layers;

wherein each reinforcing geocell is longer than any stacking geocell; and wherein the capping geocell layer is located at the top of the retaining wall.

9. The retaining wall of claim 8, further comprising a foundation geocell layer located at the bottom of the retaining wall.

* * * * *